US005118317A

United States Patent [19]

Wijnen

[11] Patent Number: 5,118,317

[45] Date of Patent: Jun. 2, 1992

[54] IMPREGNATED CATHODES WITH A CONTROLLED POROSITY

[75] Inventor: Jan F. C. M. Wijnen, Eindhoven, Netherlands

[73] Assignee: U.S. Philips Corporation, New York, N.Y.

[21] Appl. No.: 779,118

[22] Filed: Oct. 16, 1991

Related U.S. Application Data

[63] Continuation of Ser. No. 395,281, Jul. 20, 1989, abandoned, which is a continuation of Ser. No. 183,119, Apr. 19, 1988, abandoned.

[30] Foreign Application Priority Data

Apr. 21, 1987 [NL] Netherlands ..... 8700935

[51] Int. Cl.[5] ..... H01J 9/04

[52] U.S. Cl. ..... 445/50; 419/35; 445/49; 445/51

[58] Field of Search ..... 445/46, 49, 50, 51; 419/35; 313/346 R

[56] References Cited

U.S. PATENT DOCUMENTS

| | | | |
|---|---|---|---|
| 927,935 | 7/1909 | von Bolton | 419/35 |
| 2,986,465 | 5/1961 | Kurtz | 419/35 |
| 3,015,560 | 1/1962 | Thurber | 419/35 |
| 3,155,864 | 11/1964 | Coppola | 419/35 |
| 3,303,559 | 2/1967 | Holtzclaw | 445/49 |
| 3,418,103 | 12/1968 | Lasdon | 419/35 |
| 3,623,198 | 11/1971 | Held | 445/50 |
| 3,971,110 | 7/1976 | Thomas et al. | 445/51 |
| 4,498,395 | 2/1985 | Kock et al. | 419/35 |
| 4,708,681 | 11/1987 | Branovich et al. | 445/50 |

FOREIGN PATENT DOCUMENTS

| | | | |
|---|---|---|---|
| 0065424 | 4/1985 | Japan | 445/51 |

*Primary Examiner*—Kurt Rowan
*Attorney, Agent, or Firm*—J. C. Fox

[57] ABSTRACT

A storage cathode comprising a porous, sintered body of a refractory metal is produced by compacting and sintering powder particles of a refractory metal, at least a portion of which are coated, before compacting, with a thin layer of a ductile metal. As a result thereof, it is possible to compact the refractory metal powder, before sintering, at temperatures lower than 600° C., in a non-conditioned space and in an air atmosphere.

6 Claims, 3 Drawing Sheets

IMPREGNATED CATHODES WITH A CONTROLLED POROSITY

This is a continuation of application Ser. No. 07/395,281, filed on July 20, 1989, which is a continuation of Ser. No. 07/183,119, filed Apr. 19, 1988, both now abandoned.

BACKGROUND OF THE INVENTION

The invention relates to a method of producing a storage cathode comprising a porous, sintered body of a refractory metal, in which non-interlocking powder particles of a refractory metal are compacted to form a body, and the body is sintered.

Storage cathodes of this type are used in electron guns for electron tubes such as television tubes, picture pick-up tubes, travelling wave tubes, cylstrons etc. Tungsten and/or molybdenum are usually used as the refractory metals.

Methods of producing a storage cathode are known in which very irregularly shaped and interlocking powder particles of a refractory metal are compacted. Due to their interlocking nature, it is possible to compact such powders at low temperatures. During sintering, however, irregularities occur in the porosity of the sintered body, such as closed pores and fully dense sintered portions, which irregularities result in a loss in intensity and in uniformity of the emission. The present invention concerns methods using non-interlocking particles, wherein such irregularities occur much less frequently or not at all.

A method of the type defined in the opening paragraph is disclosed in the English language abstract of SU-654981-A from Derwent "World Patent Index". This disclosure describes a method in which tungsten powder, consisting of non-interlocking substantially spherical particles is compacted in a hydrogen atmosphere at a pressure of 0.1 to 1.0 Gpa, at a temperature from 1100°-1400° C. for 5 to 30 minutes. Thereafter, the compacted tungsten body is sintered in a hydrogen atmosphere at a temperature of 2000° C. for 20 minutes, whereafter the tungsten body is impregnated. The disclosed method has the drawback that the tungsten powder is compacted at elevated temperature and in a hydrogen atmosphere. This requires the use of a high-pressure press in a conditioned space. Many metals are attacked by hydrogen at such high temperatures, resulting in a degradation of these metals known as "hydrogen embrittlement". Thus, the high-pressure press appropriate for this process must be made of a metal which is immune to hydrogen embrittlement. Furthermore, this process is not so suitable for mass production as the energy required for producing a cathode is great and the process takes much time.

SUMMARY OF THE INVENTION

It is therefore an object of the invention to provide a method by which it is possible to compact non-interlocking powder particles into a body prior to sintering, at low temperatures, in a non-conditioned space and in an air atmosphere.

According to the invention, this object is accomplished by a method which is characterized in that at least a portion of the powder particles are coated, before compacting, with a thin layer of a ductile metal, and in that compacting is effected at a temperature lower than 600° C.

Within the scope of the invention, a ductile metal must be understood to mean a metal which, on compaction, provides cohesion between the powder particles. Suitable ductile metals are, for example, aluminum, copper, silver or alloys of these metals.

An important feature of the invention is that the powder particles are compacted at temperatures at which no attack of the powder particles by oxygen occurs, so that compaction need not take place in a hydrogen atmosphere. This simplifies both the method and the high-pressure press apparatus. In addition, less energy and time are required for heating of the press and of the powder particles. Generally, the required compacting pressure is lower as the temperature is higher.

In a preferred embodiment, the method is further simplified in that compaction is effected at a temperature which is substantially equal to ambient temperature. The temperature of the high-pressure press and the powder particles then need not be increased and controlled relative to the ambient temperature. Furthermore, since compacting is effected at ambient temperature, the body is immediately ready for treatment in a sintering furnace, and the press is immediately available for a new body to be compacted.

A powder partly consisting of powder particles coated with a thin layer of a ductile metal and partly of powder particles not coated with such a layer is suitable for the method of the invention. The required coherence of the compacted powder is determined not only by the amount of coated particles, but also by the distribution of the coated particles over the powder. A non-uniform distribution adversely effects cohesion, but can be overcome by increasing the amount of coated particles.

The powder particles may be of different shapes, for example, granular or spherical. It was found that uncoated spherical powder particles were particularly difficult to compact into a coherent body. The method according to the invention is therefore of particular advantage for spherical particles.

Of the refractory metal powder particles, tungsten powder particles are particularly difficult to compact into a coherent body, and the method according to the invention is of particular advantage for tungsten particles.

Of all the refractory metals, tungsten is the most difficult to compact and the method according to the invention is of particular advantage for tungsten.

In a further preferred embodiment of the method according to the invention, the ductile metal predominantly contains aluminum.

Aluminum is a cheap and relatively inert metal which has a high vapor pressure, so that the metal may completely disappear from the body during the sintering process, leaving no contamination behind in the body to possibly negatively influence the emission properties of the storage cathode.

In a still further preferred embodiment, the average thickness of the ductile layer is within the range of from about 0.005 μm to 0.1 μm, and less than 1/10th of the radius of the powder particle.

Too thin a metal layer negatively affects the compaction properties of the powder, while too thick a layer (the thickness exceeds 1/10 part of the radius of the particles or exceeds 0.1 μm), may adversely affect the sintering properties of the compacted powder, as then the distance between the particles is comparatively great.

In a still further preferred embodiment, the average thickness of the thin layer of ductile material is in the range of from about 0.01 to 0.03 μm within which the compaction and sintering properties of the powders are substantially optimal.

BRIEF DESCRIPTION OF THE DRAWINGS

Some embodiments of the invention will now be described by way of example with reference to the accompanying drawing in which.

DESCRIPTION OF THE PREFERRED EMBODIMENTS

Figure 1:
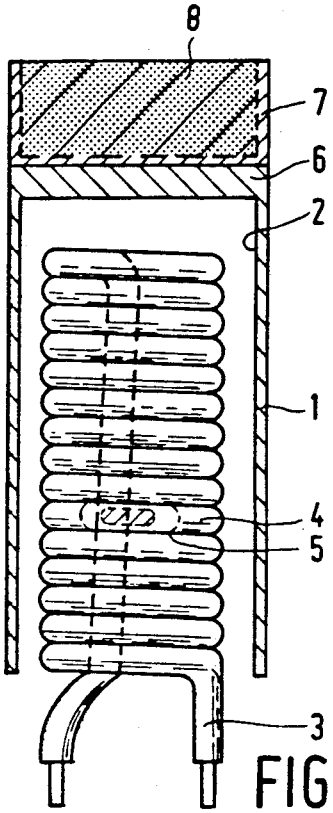
FIG. 1 is a schematic, partly cross-sectional view of a storage cathode produced by the method of the invention.

In FIG. 1 a schematic, partly cross-sectional view of a storage cathode produced by the method of the invention is shown. The cathode shaft 1, which is blackened at its interior side, surrounds the heater 3. The heater 3 consists of a metal core 4 which is provided with a coating 5, which is black at least at its surface. The end face 6 of the cathode shaft 1 is provided with a holder 7. The holder 7 envelops the impregnated tungsten body 8.

Figure 2:
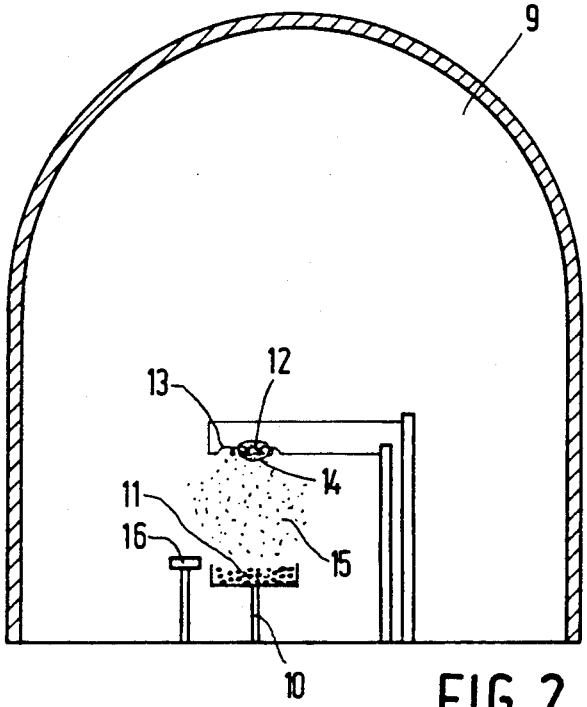
FIGS. 2 and 3 shows schematically and in cross-section a vapor deposition arrangement to produce coated particles by the method of the invention.

In FIG. 2 is shown a vacuum deposition arrangement suitable for use with the method of the invention. In a vacuum space 9, a holder 10 for substantially spherical particles of tungsten powder 11 is present. The holder 10 is regularly kept in motion so that the powder is regularly shaken. This motion can for example, be effected by vibration. This promotes a uniform distribution of the vapor-deposited aluminum over the tungsten powder. An aluminum sample 12 is heated to a high temperature in a tungsten coil 13 by resistance heating, so that aluminum atoms evaporate from the surface 14 of the aluminum sample 12. These atoms, which in the Figure are represented by dots 15, are deposited on the tungsten powder 11, thus coating the tungsten particles with a layer of aluminum. The quantity of aluminum deposited can be checked by means of surface thickness gauge 16 during or after the vacuum deposition process. The pumps required for providing a vacuum, and also electric supply wires and any further components arranged in the vacuum space which are customary for such known vacuum deposition arrangements, are not shown in this Figure.

Figure 3:
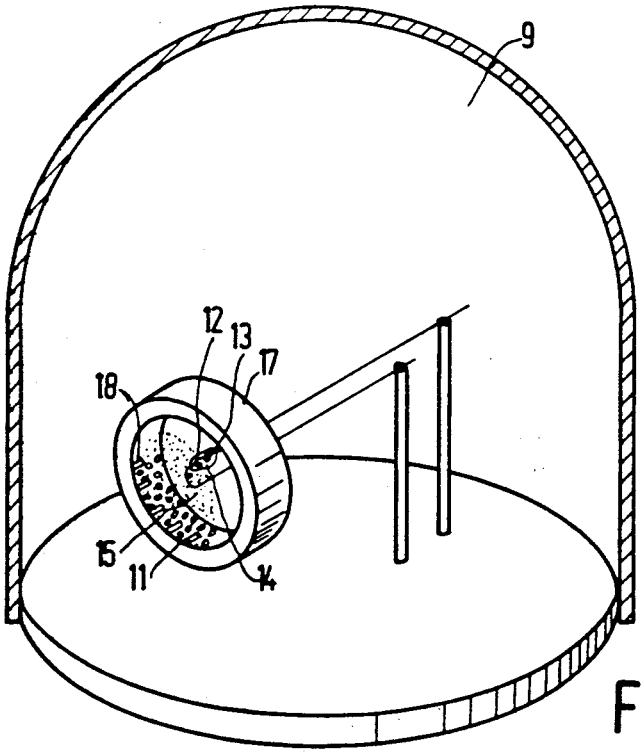

FIG. 3 is a cross-sectional view of another embodiment of a vapor deposition arrangement suitable for use with the method of the invention. The tungsten powder 11 is here contained in a rotating tread mill 17, which is provided with fins. 18. The tungsten powder is kept in constant motion so as to obtain as uniform a distribution of the aluminum over the surface of the particles as possible. The fins 18 can be of such a large size that the particles make a free fall.

Variations in the manner of vacuum coating aluminum shown here include different configurations for resistance heating of the sample, heating of the sample by means of a high-frequency field, by means of a concentrated electron beam or by means of a concentrated ion beam, and removing atoms or sub-microscopic particles from the sample by means of a concentrated electron beam or a concentrated ion beam, i.e., sputtering. In addition to vacuum coating and sputtering, further suitable methods include chemical vapor deposition, methods in which the metal is deposited ont he tungsten particles from a solution of the metal, thus forming a metal layer on the tungsten particles, and combinations of any of these methods. The layer may be provided as a metal compound or a metal alloy, the metal compound or metal alloy simultaneously or subsequently being converted into a layer of ductile metal.

Figure 4:
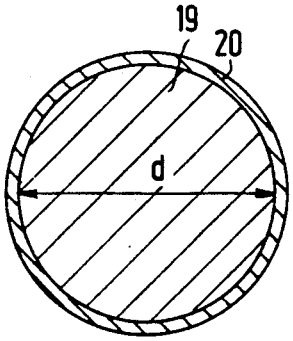
FIG. 4 shows in cross-section a spherical particle of tungsten powder provided with an aluminum layer.

FIG. 4 shows a cross-section of a substantially spherical particle 19 of the tungsten powder coated with an aluminum layer 20. In this Figure the thickness of the aluminum layer is shown, for the sake of clarity, greatly increased relative to the other dimensions. In this example the diameter d of the particle is 10 μm, the average thickness of the aluminum layer is 0.02 μm. Generally, diameters in the range from 0.1 to 30 μm are suitable. In this Figure, although the thickness of the coating of aluminum is shown as being of a constant value over the surface of the particles, non-uniformities in the thickness of the aluminum layer may occur.

Figure 5:
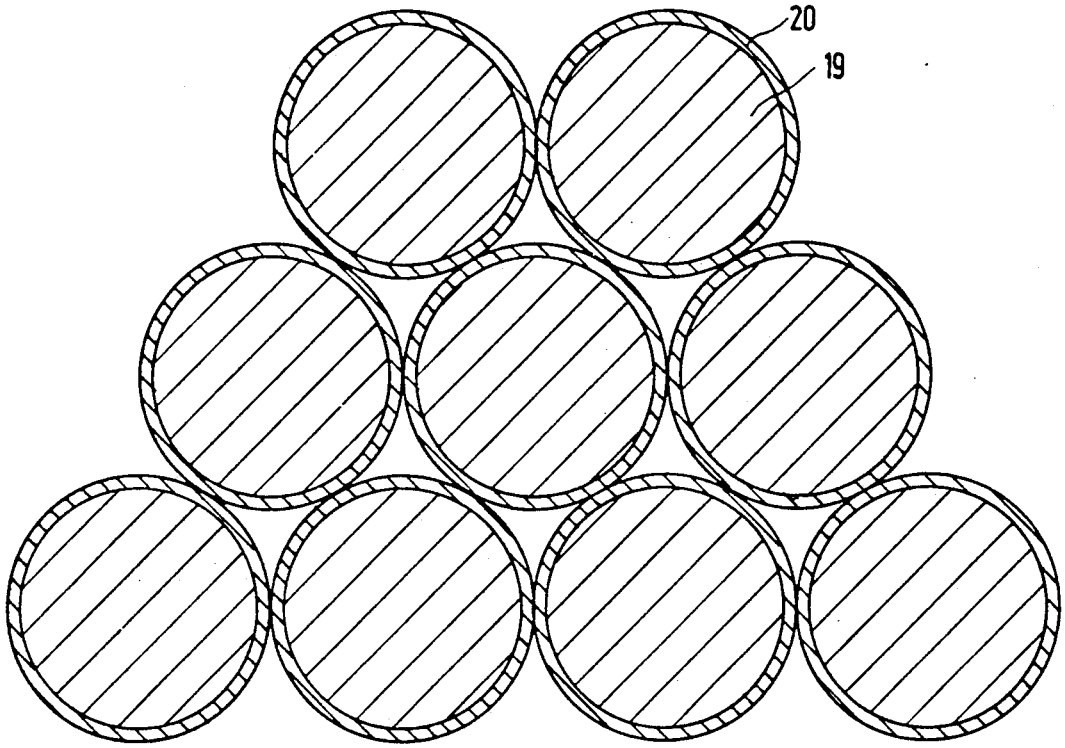
FIG. 5 shows in cross-section a two-dimensional stack of spherical particles of tungsten powder, coated with a layer of aluminum.

FIG. 5 shows in cross-section a two-dimensional stack of spherical particles 19 of tungsten powder coated with an aluminum layer 20 of the type shown in FIG. 4. Although the diameters of the particles are shown as being constant, variations in the cross-section of the particles may occur.

Figure 6:
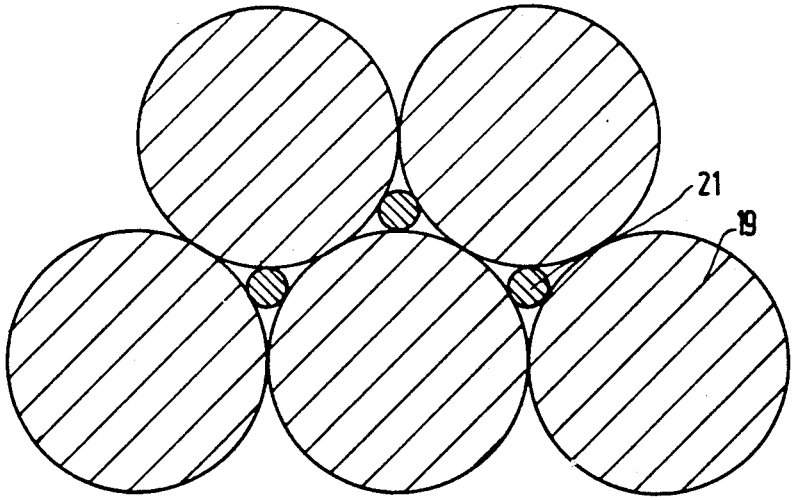
FIG. 6 shows in cross-section a two-dimensional stack of two types of spherical particles.

FIG. 6 shows a two-dimensional stack of two sizes of substantially spherical particles 19 and 21. Compared with FIG. 5, it is obvious that the interstices between the particles are reduced in size, but the number of points of contact between the particles, and the surface area of the stack are increased. This figure illustrates that a person skilled in the art can influence the properties of the storage cathode by the use of two (or more) sizes of tungsten powder, i.e., particles of different average diameters.

Figure 7:
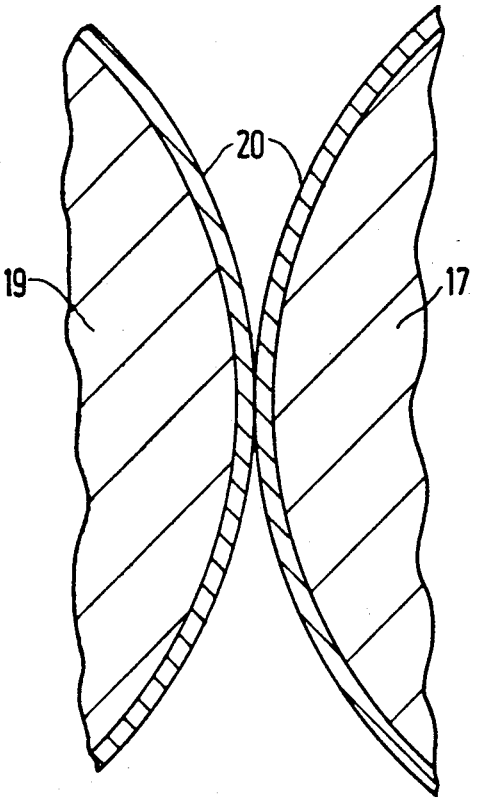
FIGS. 7 and 8 are cross-sectional views of a detail of FIG. 5, before and after compaction.

FIG. 7 shows a detail of FIG. 5, the point of contact before compaction of two particles 19 of the tungsten powder 11, coated with an aluminum layer 20, with the aluminum layers 20 in abutting contact.

Figure 8:
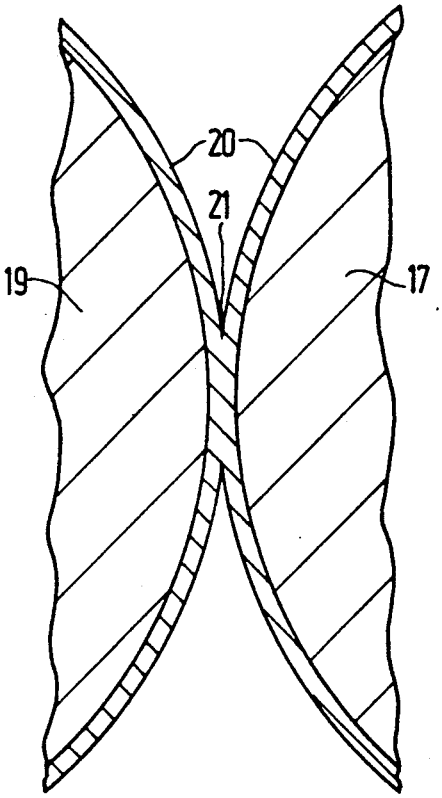

FIG. 8 illustrates the same detail after compaction, showing that a cold compression bond 21 is produced between particles 19.

Figure 9A:
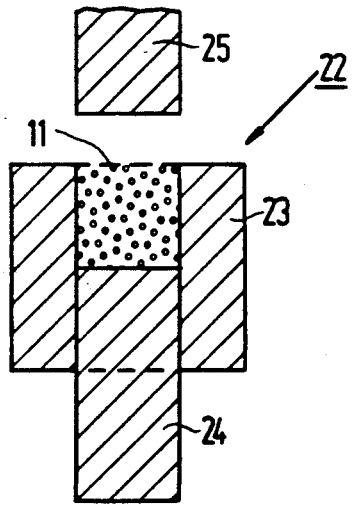
FIGS. 9*a* and 9*b* are cross-sectional views of a press for compacting a tungsten body.
Figure 9B:
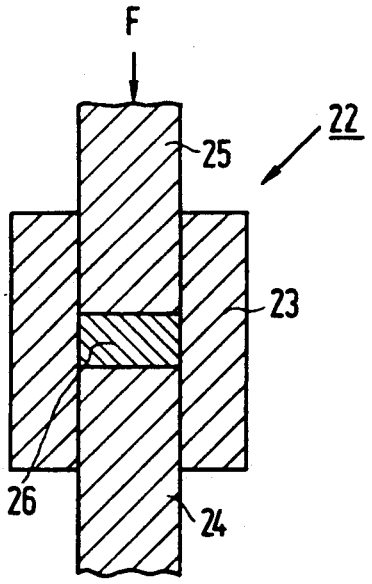

FIGS. 9*a* and 9*b* illustrate schematically and in cross-section the aluminum-coated tungsten powder before and during compacting. In the press 22, which is comprised of holder 23 and cylinders 24 and 25, tungsten powder 11 is compacted into tungsten body 26 by exerting a force F on cylinder 25. In practice forces of 0.1 to 1.0 Gpa appeared to yield satisfactory results. The force applied must be sufficient to produce cold compression bonds between the particles. After compaction, the tungsten powder is sintered in a known manner in a hydrogen atmosphere for, for example, 2 hours at a temperature of 1800° C. Hereafter, the tungsten body is impregnated in the manner known, for example, with Ba-Ca-Al compounds, to result in an electron emissive structure.

What is claimed is:

1. A method of producing a storage cathode comprising a porous, sintered body of a refractory metal, the method comprising compacting individual non-interlocking powder particles of a refractory metal into a body and sintering the body, characterized in that at least a portion of the powder particles are individually coated, before compacting, with a thin layer of a ductile metal, the layer having an average thickness within the range of about 0.005 μm and less than 1/10 of the radius of the powder particles, and in that compacting of the individual, coated particles is effected at a temperature lower than 600° C.

2. A method as claimed in claim 1, in which compacting is effected at a temperature substantially equal to ambient temperature.

3. A method as claimed in claim 1, in which substantially all the powder particles are provided with a layer of a ductile metal.

4. A method as claimed in claim 1, in which the powder particles are substantially of a spherical shape.

5. A method as claimed in claim 1, in which the refractory metal is tungsten.

6. A method as claimed in claim 1, in which the average thickness of the layer of ductile metal is located in the range of from about 0.01 to 0.03 μm.

* * * * *